US009067122B2

(12) United States Patent
Diamond

(10) Patent No.: US 9,067,122 B2
(45) Date of Patent: Jun. 30, 2015

(54) PROTECTIVE ATHLETIC GARMENT AND METHOD

(71) Applicant: Richard Diamond, Far Hills, NJ (US)

(72) Inventor: Richard Diamond, Far Hills, NJ (US)

( * ) Notice: Subject to any disclaimer, the term of this patent is extended or adjusted under 35 U.S.C. 154(b) by 198 days.

(21) Appl. No.: 13/925,214

(22) Filed: Jun. 24, 2013

(65) Prior Publication Data

US 2013/0283511 A1 Oct. 31, 2013

Related U.S. Application Data

(63) Continuation-in-part of application No. 13/064,336, filed on Mar. 21, 2011, now abandoned.

(51) Int. Cl.

| | |
|---|---|
| ***A41D 27/26*** | (2006.01) |
| ***A63B 71/12*** | (2006.01) |
| ***A41D 13/015*** | (2006.01) |
| *A41D 27/12* | (2006.01) |
| *A41D 13/00* | (2006.01) |

(52) U.S. Cl.
CPC ..... *A63B 71/12* (2013.01); *A41D 13/00* (2013.01); *A41D 13/0153* (2013.01)

(58) Field of Classification Search
CPC ..... A41D 13/00
USPC ..... 2/459, 455
See application file for complete search history.

(56) References Cited

U.S. PATENT DOCUMENTS

| | | | | |
|---|---|---|---|---|
| 3,770,560 | A * | 11/1973 | Elder et al. | 428/138 |
| 4,453,271 | A * | 6/1984 | Donzis | 2/456 |
| 4,490,887 | A * | 1/1985 | Sarton et al. | 24/16 PB |
| 4,610,034 | A * | 9/1986 | Johnson | 2/459 |
| 4,700,407 | A | 10/1987 | Mattila | |
| 4,810,559 | A | 3/1989 | Fortier et al. | |
| 4,870,706 | A | 10/1989 | Ketcham et al. | |
| 5,007,108 | A * | 4/1991 | Laberge et al. | 2/463 |
| 5,105,473 | A | 4/1992 | Valtakari | |
| 5,235,703 | A | 8/1993 | Maynard | |
| 5,551,082 | A | 9/1996 | Stewart et al. | |
| 6,058,503 | A | 5/2000 | Williams | |
| 6,205,583 | B1 * | 3/2001 | Beland | 2/16 |
| 2007/0199129 | A1 | 8/2007 | Davis | |
| 2009/0044319 | A1 | 2/2009 | Lamson et al. | |

* cited by examiner

*Primary Examiner* — Bobby Muromoto, Jr.
*Assistant Examiner* — Jillian K Pierorazio
(74) *Attorney, Agent, or Firm* — Thomas J. Germinario

(57) ABSTRACT

A protective athletic garment provides segmented padding is patterned to conform to the size, shape and motion of the muscles it is protecting. Segmented padding is supplemented in joint areas by tangentially-stepped articulated shielding, each comprising a hingeably interconnected series of rigid shells. The structure and orientation of the shells deflects impact forces tangentially, while the rotational mobility of the shielding has a force-damping effect. The protective athletic garment has a combination of latticed resilient padding covering vulnerable body areas, such as chest, arms and back, plus articulated, perforated rigid shield panels over joints areas, such as shoulders and elbows. Synergistic dynamic interaction of padding and shielding is achieved by converting impact forces to torques within a series of articulated shield panels and spreading out the forces transmitted to the underlying padding both over area and time.

4 Claims, 19 Drawing Sheets

PROTECTIVE ATHLETIC GARMENT AND METHOD

REFERENCE TO RELATED PATENT APPLICATION

The present application is a continuation-in-part of U.S. patent application Ser. No. 13/064,336, filed on Mar. 21, 2011.

BACKGROUND OF THE INVENTION

The present invention relates to the field of protective garments, and more particularly to garments to protect athletes competing in contact sports, such as lacrosse, football, hockey and motocross. While the present invention is primarily directed to protective athletic garments, however, it is also applicable to garments used in any activity involving potential high-impact bodily contact where there is a need provide protection without unduly restricting mobility.

Protective garments and equipment designed for use in contact sports typically rely on two modes of dissipating impact forces: padding and shielding. Padding dissipates the force through elastic deformation of the padding material, while shielding deflects a portion of the force away from the body. Optimally, padding and shielding are used in combination, with padding underlying shielding, so that undeflected forces transmitted through the shield can be absorbed by the padding beneath.

The major problem in designing effective athletic gear is the need to balance protection versus mobility. Even within the same sport, different degrees and types of protection and mobility are often demanded for different position players. Shoulder protectors suitable for a football lineman, for example, would be much too confining for a quarterback or wide receiver, while a quarterback's lighter padding would be ineffective for blocking on the line.

One way to provide both mobility and protection is to segment or articulate the padding and/or shielding, leaving interstices and/or joints within which flexing and bending can take place. Segmentation and/or articulation of both padding and shielding is needed to provide mobility where both modes of protection are being deployed in conjunction with one another. But, since segmentation and articulation introduce additional degrees of freedom of movement to padding and shielding beyond that associated with their protective functions, it's important that the mobility dynamics of the padding and shielding not work at cross purposes to their protective dynamics.

For example, a simplistic approach to segmenting an elbow protector would be to split it above and below the joint. But, while facilitating elbow movement, such segmentation would also leave the most sensitive outer part of the elbow exposed every time the elbow was bent.

Another important consideration in designing articulated body protection is the interaction between the padding and the shielding. For example, foam padding underlying a one-piece shield panel will compress downward to dissipate a downward force applied to the panel. But the same padding beneath a two-piece panel may be subject to sideward pressure which limits its downward compression and reduces force dissipation.

The prior art in this field includes garments in which segmented padding is inserted into pockets or openings in the garment. Examples of these garments are disclosed by Mattila, U.S. Pat. No. 4,700,407, Ketcham et al., U.S. Pat. No. 4,870,706, Valtakari, U.S. Pat. No. 5,105,473, and Davis, U.S. Pat. Pub. No. 2007/0199129. While pocket-type padding has the advantage of versatility, the padding adds to the bulk of the garment and impedes mobility.

Several prior art patents/applications teach the use of segmented protective pads which are integrated within the fabric of the garment. Examples of such integrated segmented padding designs appear in Fortier et al., U.S. Pat. No. 4,810,559, Stewart et al., U.S. Pat. No. 5,551,082, and Lamson et al., U.S. Pat. Pub. No. 2009/0044319. A joint protector with articulated padding is disclosed by Williams, U.S. Pat. No. 6,058,503, in which the resilient members conform to the contours of the protected joint.

The combination of segmented padding with overlying non-articulated panels is taught by Donzis, U.S. Pat. No. 4,453,271, wherein the panels conform to body contours, as do the pocket-insert panels disclosed by Valtakari and Davis. An upper body protector comprising inflatable air cells in combination with rigid non-articulated plastic epaulets is taught by Maynard, U.S. Pat. No. 5,235,703.

The present invention improves upon the prior art by providing a protective garment with a combination of latticed resilient padding covering vulnerable body areas, such as chest, arms and back, plus articulated, perforated rigid shield panels over joints areas, such as shoulders and elbows. Synergistic dynamic interaction of padding and shielding is achieved by converting impact forces to torques within a series of articulated shield panels and spreading out the forces transmitted to the underlying padding both over area and time.

SUMMARY OF THE INVENTION

The present invention can be practiced in a number of embodiments, which should be understood before one specific embodiment is described in detail. For illustrative purposes, some of these embodiments will now be discussed for the purpose of conveying a better understanding of the general intent of the present invention. It should be understood, however, that neither the following illustrative embodiments, nor the detailed embodiment described in the next section of this application, are intended to limit the scope of the present invention.

The present invention uses latticed resilient padding in conjunction with articulated, perforated shielding comprising a series of interconnected light-weight shield rigid panels. By "latticed," it is meant that the padding has a open structure, through which air can circulate, comprising flexibly interconnected lattice subunits, each having a central cavity defined by a perimeter wall that is either polygonal, circular, oval, or elliptical in shape. By "perforated" it is meant that the shield panels are penetrated by a series of apertures, through which air can circulate. The purpose of the latticed padding and perforated shield panels is to reduce the weight of the padding/shielding as well as to improve its flexibility.

The garment has an outer layer and a liner layer, with some padding material distributed over various areas between the two layers, and other padding material attached to the outer layer and projecting above it. The former will be referred to as "interior padding" and the latter as "exterior padding". The padding material can consist of a gel, such as semi-solid silicone, a foam, such as open-cell polyurethane, or a polymer composite. Cells filled with compressed air or gas, as well as inflatable air bladders, can also be used as padding material.

Segmentation of the padding is patterned to conform to the size, shape and motion of the muscles it is protecting. Using the front of an upper body garment as an example, interior padding over the chest could comprise two large triangular foam segments over the right and left pectorals separated by an exterior vertical oblong strip of raised square or rectangular gel segments over the sternum. The outer sides of the upper arms and forearms could be covered with exterior padding comprising clusters of cubical or hemispherical cells containing compressed air, for greater mobility. Over the clavicle, exterior padding might consists of narrow raised polymer strips running across the shoulder, so as not to impede the upward movement of the arm.

The articulated shielding is designed to direct impact forces in a direction tangential to the contours of the protected body area. Over the shoulder, for example, the shielding might comprise a series of flexibly interconnected shells arranged in a stepped configuration. Each of the shells would have multiple flat or slightly convex outer surfaces tangentially aligned with respect to the underlying shoulder contours. The shells would be fabricated from a light-weight impact-resistant plastic, fracture-resistant long glass fiber nylon, or ceramic material. The interconnection between the shells would permit each of the shells to rotate upward, sliding partially under the adjacent shell as the arm is raised.

The tangentially-stepped articulated shielding of the present invention will dissipate impact forces in two ways. First, an oblique impact to one of the shells will tend to move it in the direction of least resistance, which is at a tangent to the underlying body contour, so that the orthogonal component of the force is re-directed and deflected. Second, an orthogonal or oblique impact to one of the shells will generate a torque causing the shell to rotate about the hinge connecting it to the adjacent shell. This rotational motion will be transmitted down the series of interconnected shells, thereby generating an undulating movement which tends to dampen the force. Since this undulating motion of the shielding has both horizontal and vertical components, the orthogonal force component is again reduced. Moreover, the undulating transmission extends the force over a larger body area and protracts the time interval during which the force is applied to the body, thereby reducing the resulting pressure on the body.

As applied to protect bodily joint areas, the articulation of the shielding is configured to allow motion in accordance with the structure of the bodily joint. For example, over hinge joints, such as the elbow and the knee, the articulated shield segments are interconnected by hinges comprising flexible interstitial connecting bands (see FIG. 4A, reference number 32), which can either be continuous with and integral to the shield or discrete connectors. Such hinged articulated shielding has one degree of freedom, thereby allowing the elbow/knee joint to move back and forth in one plane.

On the other hand, over ball-and-socket joints, such as the shoulder and hip, the articulated shield comprises discrete segments interconnected by discrete flexible interstitial ties or cords (see FIG. 6A, reference number 45). Such tied segmented shielding has three degrees of freedom, thereby allowing the shoulder/hip joint to move around in three planes.

As applied to protect torso areas, the shielding comprises non-articulated, rigid perforated panels (see FIG. 8A). The torso panels substantially conform to the shape of the covered torso area. Shielding over the upper chest, for example, comprises substantially triangular panels conforming to the shape of the pectoral muscles (as illustrated in FIG. 2A, reference number 18).

The padding underlying the shielding is also adapted to the required range of motion of the bodily area it is protecting. As applied to a hinge joint like the elbow, for example, the padding need only be capable of bending in one plane. Therefore, the hinge joint padding has a close lattice structure, that is, with less than 50% cavity space (see FIG. 5B) and is thicker in the central area directly over the joint (see FIG. 5C). On the other hand, as applied to a ball-and-socket joint like the shoulder, the padding must be capable of bending in all three planes. Therefore, the socket joint padding has an open lattice structure, that is, with more than 50% cavity space (see FIG. 7B) and has a uniform thickness.

As applied to protect torso areas, the padding need only be capable of flexing with minimal bending, therefore, the torso padding has a very close lattice structure, that is, with less than 40% cavity space (see FIG. 9), and with a uniform thickness.

BRIEF DESCRIPTION OF THE DRAWINGS

FIG. 3E is a detail side view of the elbow shielding component of an exemplary upper torso protective garment, according to one of the preferred embodiments of the present invention;

DETAILED DESCRIPTION OF THE PREFERRED EMBODIMENTS

Figures 1A, 1B, 1C:
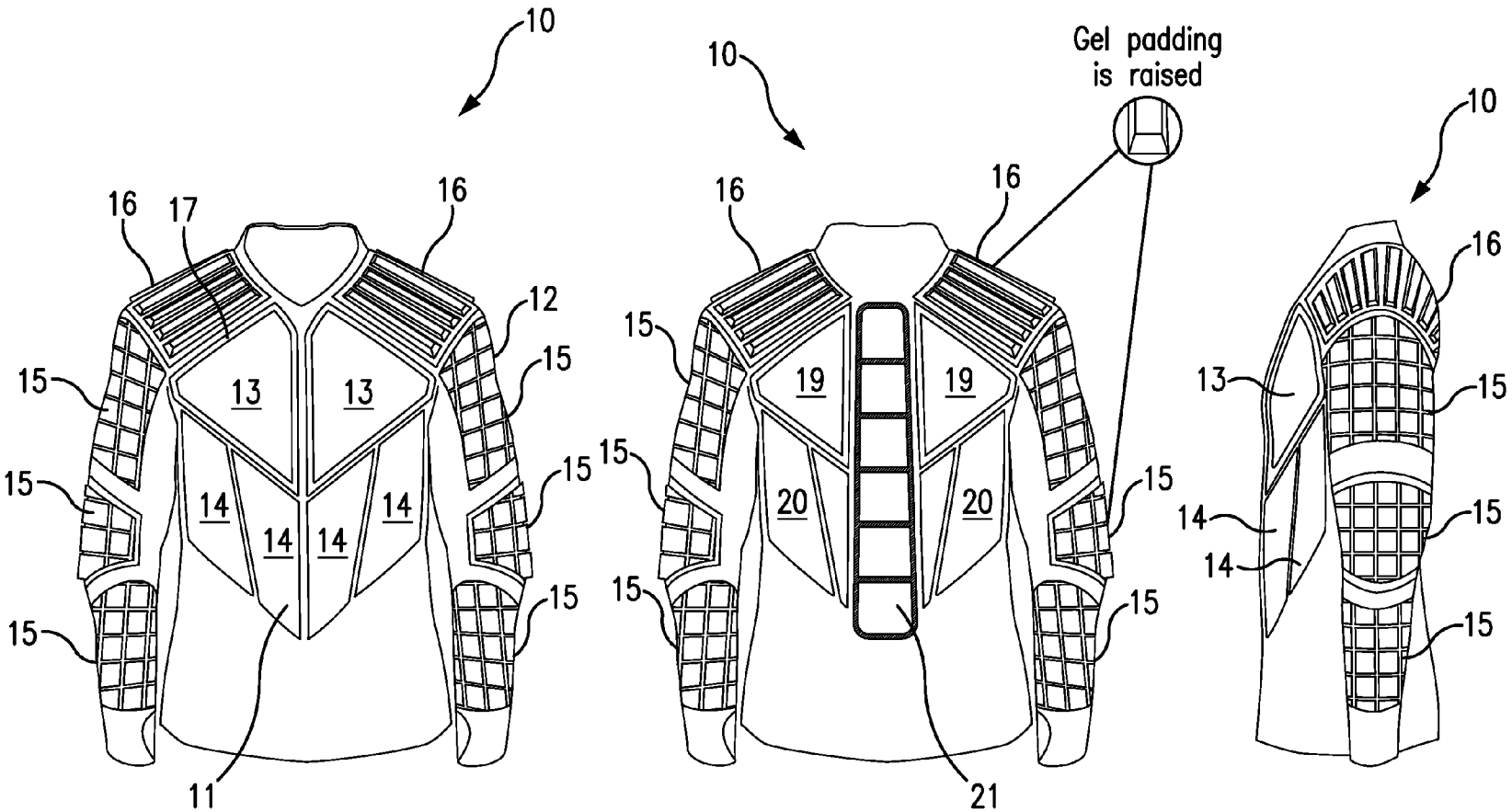
FIGS. 1A, 1B and 1C are front, back and left side views, respectively, of an exemplary upper torso protective garment, without the shielding components, according to one of the preferred embodiments of the present invention.

Referring to FIGS. 1A and 1C, the front and sides of the exemplary upper torso protective garment 10 include both interior padding 11 and exterior padding 12. The interior chest padding 13 over the pectorals comprises two triangular pads of open cell polyurethane foam, approximately two to three inches thick. The interior rib-cage padding 14 comprises four semi-trapezoidal pads, likewise consisting of open cell polyurethane foam, approximately two to three inches thick. The exterior arm padding 15 comprises three clusters of raised cubical gel cells, approximately one-quarter to one-half inch in height, positioned over the outer surfaces of the upper arm, elbow and forearm. The exterior shoulder padding 16 comprises multiple narrow raised gel strips, approximately one-quarter to one-half inch in height, running front to back across the clavicle area. The outer garment layer above each of the pectorals is optionally provided with a pocket 17 into which a rigid breast plate 18 (see FIG. 2A) can be inserted.

Referring to FIG. 1B, the back of the exemplary upper torso garment 10 includes the exterior arm 15 and shoulder 16 padding described above. In addition, there is interior upper back padding 19 over the scapula areas comprising two triangular pads and interior lower back padding 20 over the latissimus dorsi areas comprising four semi-trapezoidal pads, with the pads in both cases consisting of open cell polyurethane foam, approximately two to three inches thick. Exterior spinal padding 21 over the backbone area comprises an oblong strip of raised cubical gel cells, approximately one-quarter to one-half inch in height.

Figures 2A, 2B, 2C:
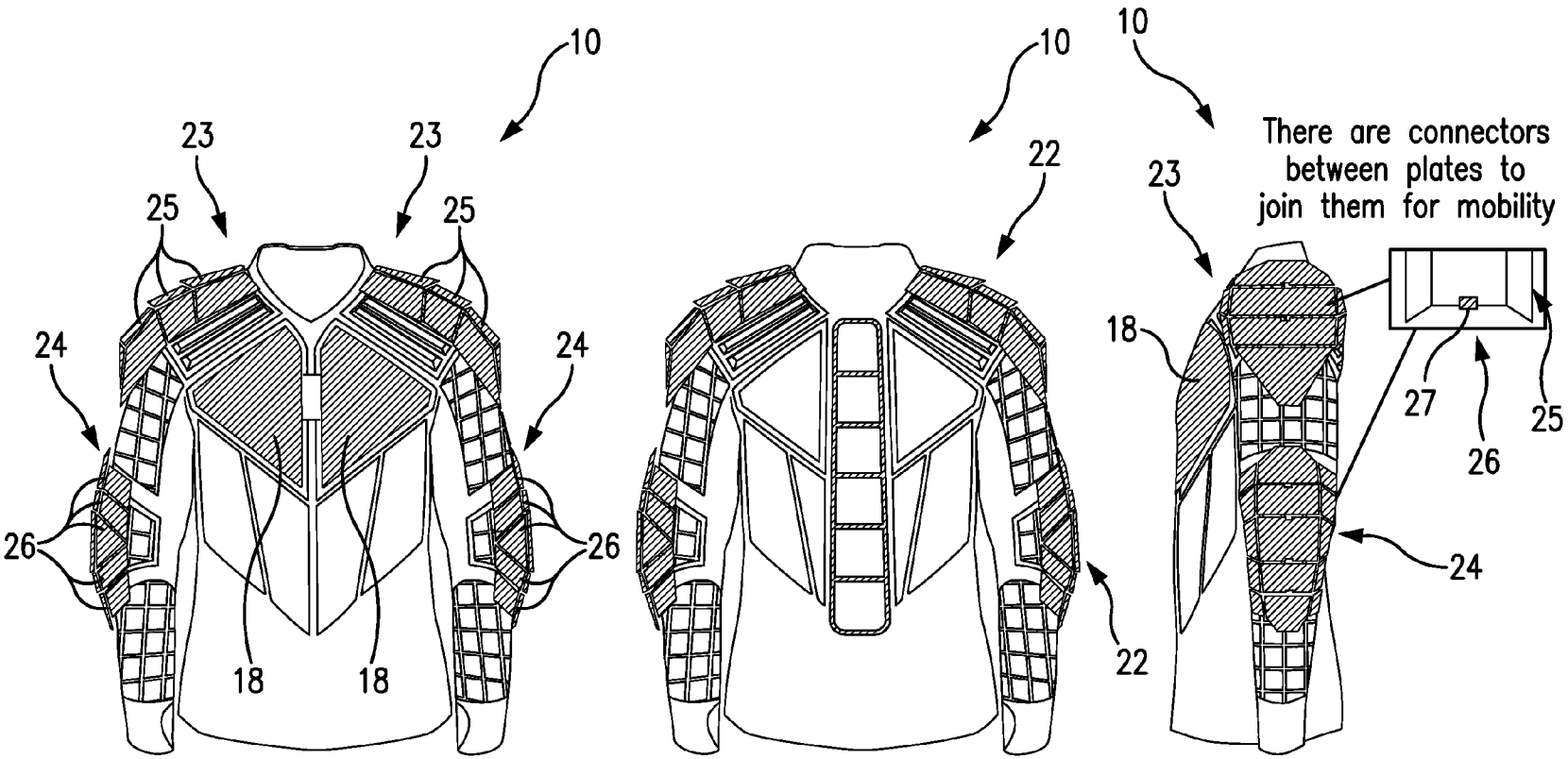
FIGS. 2A, 2B and 2C are front, back and left side views, respectively, of an exemplary upper torso protective garment, with the shielding components, according to one of the preferred embodiments of the present invention.

Referring to FIGS. 2A, 2B and 2C, tangentially-stepped articulated shielding 22 is attached over the padding and consists of two shoulder shields 23 and two elbow shields 24. Optionally, as mentioned above, two triangular breast plates 18 can also be inserted into the pockets 17 for added protection of the pectoral areas. Preferably, the shielding 22 and breast plates 18, are fabricated from a light-weight, rigid impact-resistant plastic or ceramic. Each of the shoulder shields 23 comprises three interconnected shoulder shells 25, each having an open-rectangular or convex shape. Each shoulder shell 25 is hingeably connected at its base to the next adjacent shell 25, such that each of the shells 25 can rotate upward and slide partially under the next adjacent shell when the garment wearer raises his/her arm. Each of the elbow shields 24 comprises five interconnected elbow shells 26, each having an open-rectangular or convex shape. Each elbow shell 26 is hingeably connected at its base to the next adjacent shell 26, such that each of the shells 26 can rotate upward and slide partially under the next adjacent shell when the garment wearer bends his/her arm.

Figure 3A:
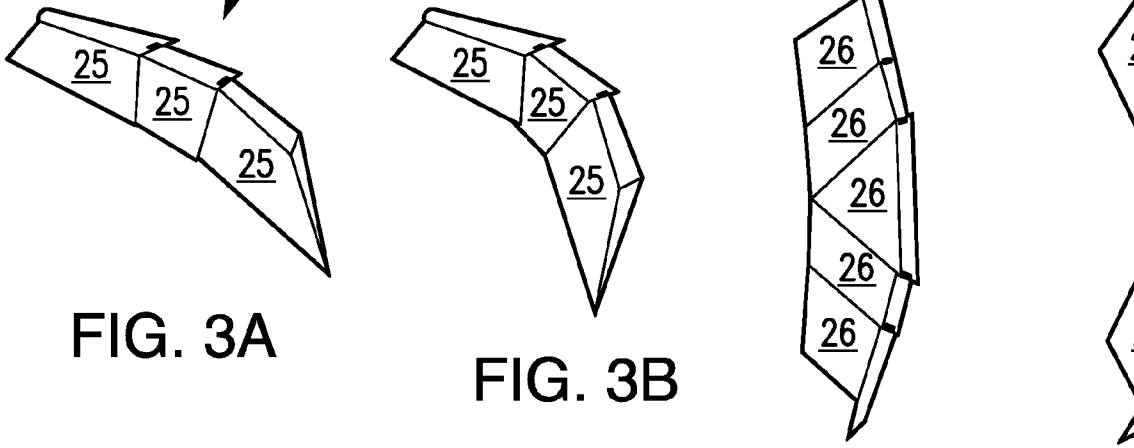
FIGS. 3A, 3B, and 3E are detail front views of the shoulder shielding component of an exemplary upper torso protective garment, according to one of the preferred embodiments of the present invention.
Figure 3B:
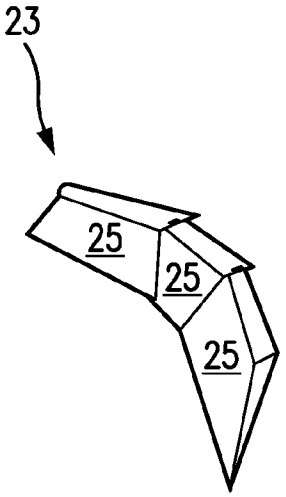
Figure 3C:
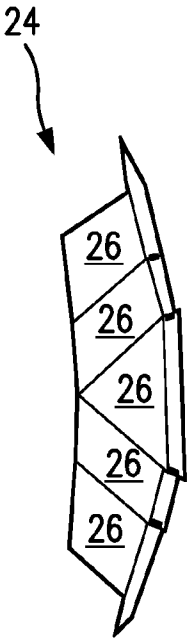
FIGS. 3C and 3D are detail front views.
Figure 3D:
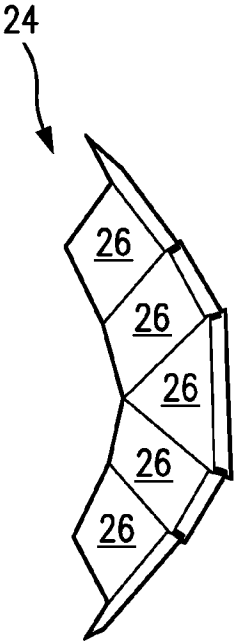
Figure 3E:
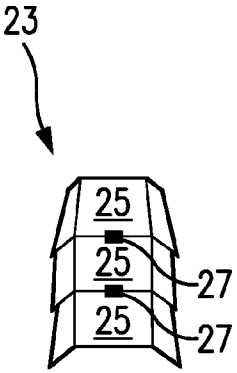

As illustrated in FIGS. 2C and 3E, for the shoulder shells 25 and the elbow shells 26, the hinged connections between the base edges of each shell and the top edges of the adjacent shells preferably comprise a series of rectangular thin plastic flexible connection strips 27, of the type found on the strap section of a cable tie. The flexible connector strips 27 can be more or less elongated and/or more or less flexible to enable a greater or lesser range of motion between the shells. By enabling both translational and rotational movement between the shells, the flexible connector strips 27 serve to transmit impact forces along the interconnected shells so as to deflect the forces away from the wearer's body, as well as to dissipate and damp the forces by generating an undulating motion among the shells, as discussed hereinabove.

FIGS. 3A, 3B and 3E illustrate in detail the tangentially-stepped articulated structure of one of the shoulder shields 23. The rotational movement of the shoulder shells 25 when the arm is raised can be seen by comparing FIG. 3A with FIG. 3C. FIGS. 3C and 3D illustrate in detail the tangentially-stepped articulated structure of one of the elbow shields 24. The rotational movement of the elbow shells 26 when the elbow is bent can be seen by comparing FIG. 3D with FIG. 3C.

Figure 4A:
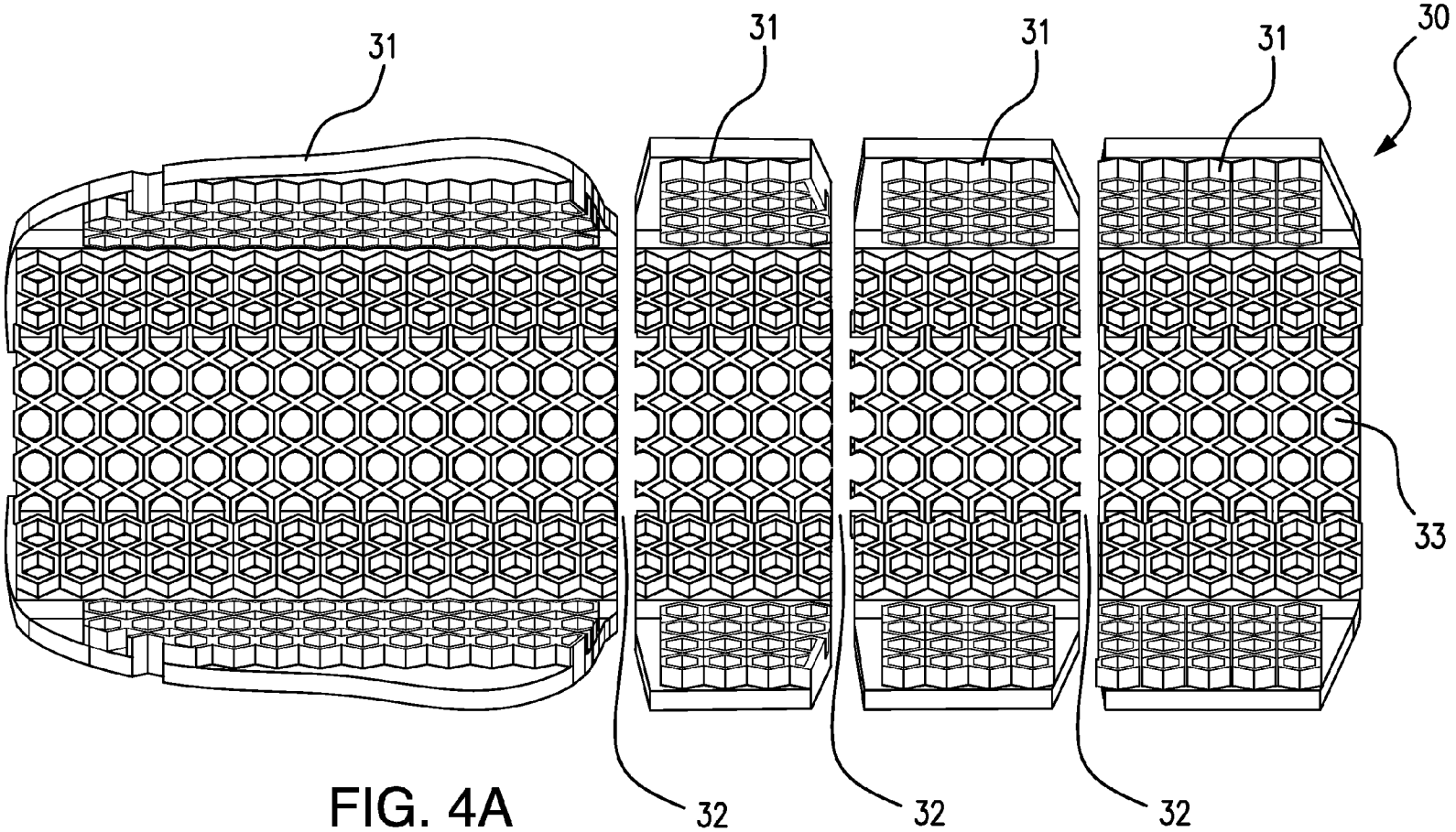
FIGS. 4A, 4B and 4C are a top, side and bottom perspective view, respectively, of an exemplary hinged articulated elbow shield according to one of the preferred embodiments of the present invention.
Figure 4B:
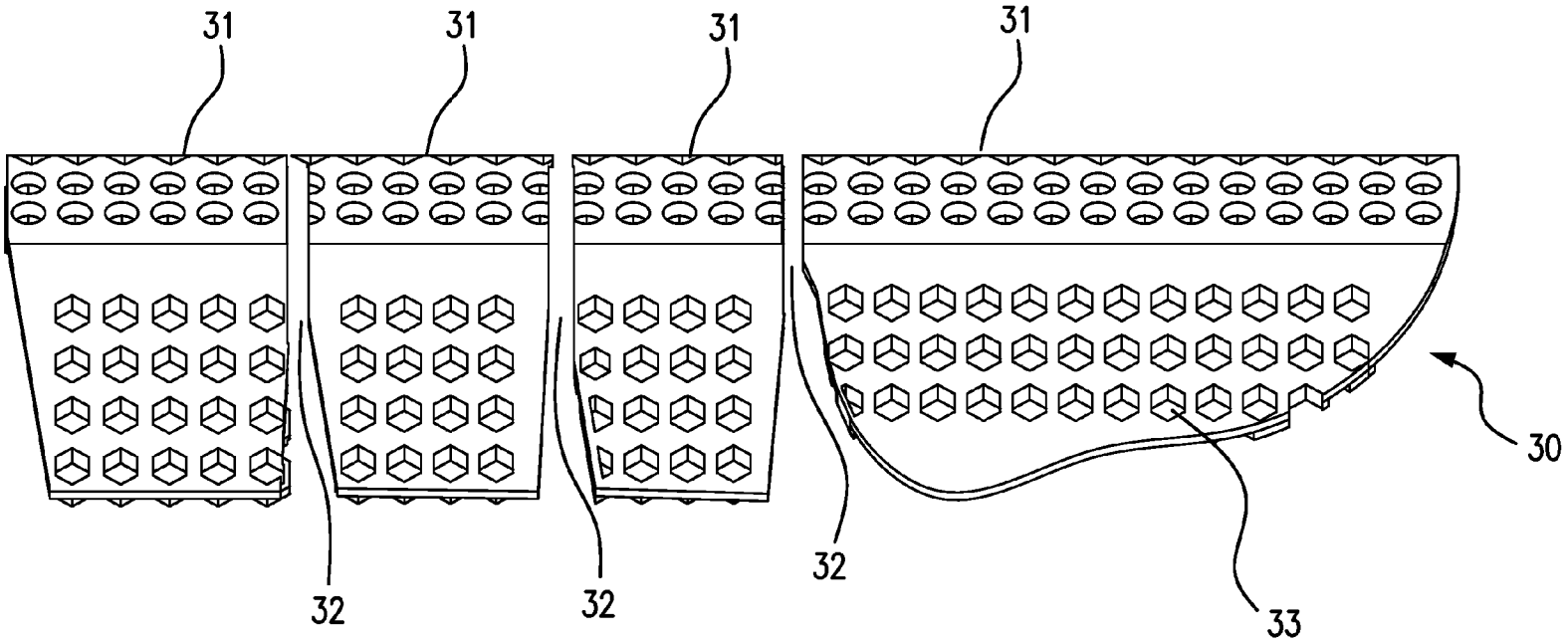
Figure 4C:
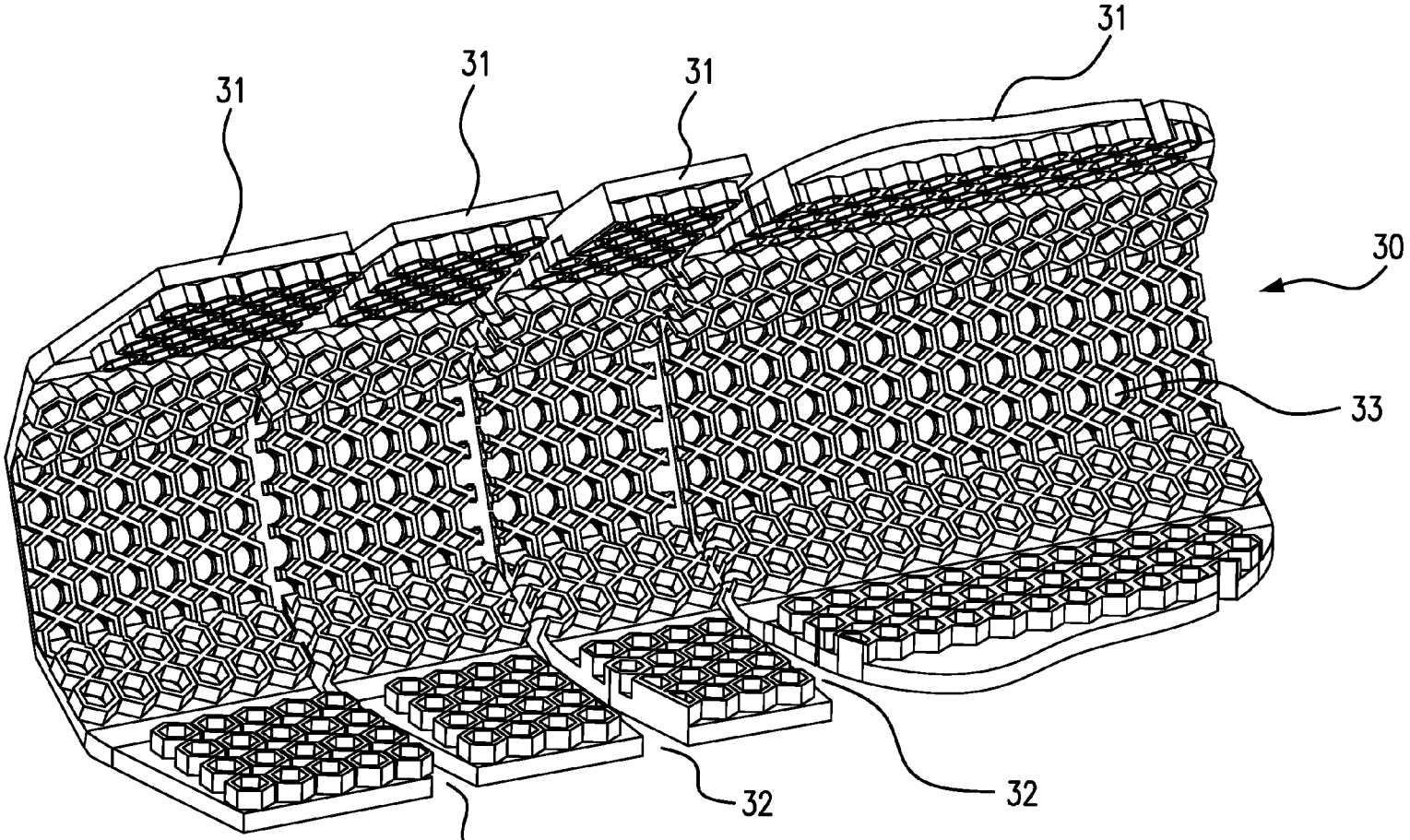

FIGS. 4A-4C illustrates an exemplary rigid shield for a hinge joint—in this case the elbow joint. The exemplary elbow shield 30 comprises four articulated arcuate shield segments 31 hingeably interconnected by three integral flexible connecting bands 32. The connecting bands 32 act as hinges between the shield segments 31, permitting them to bend in a single plane with respect to one another in order to accommodate the bending motion of an elbow. The shield segments 31 have a uniform grid of perforations 33 to reduce their weight and allow air to circulate through them for better ventilation. Preferably, the elbow shield 30 is made of a lightweight, durable thermoplastic polymer, such as polycarbonate.

Figure 5A:
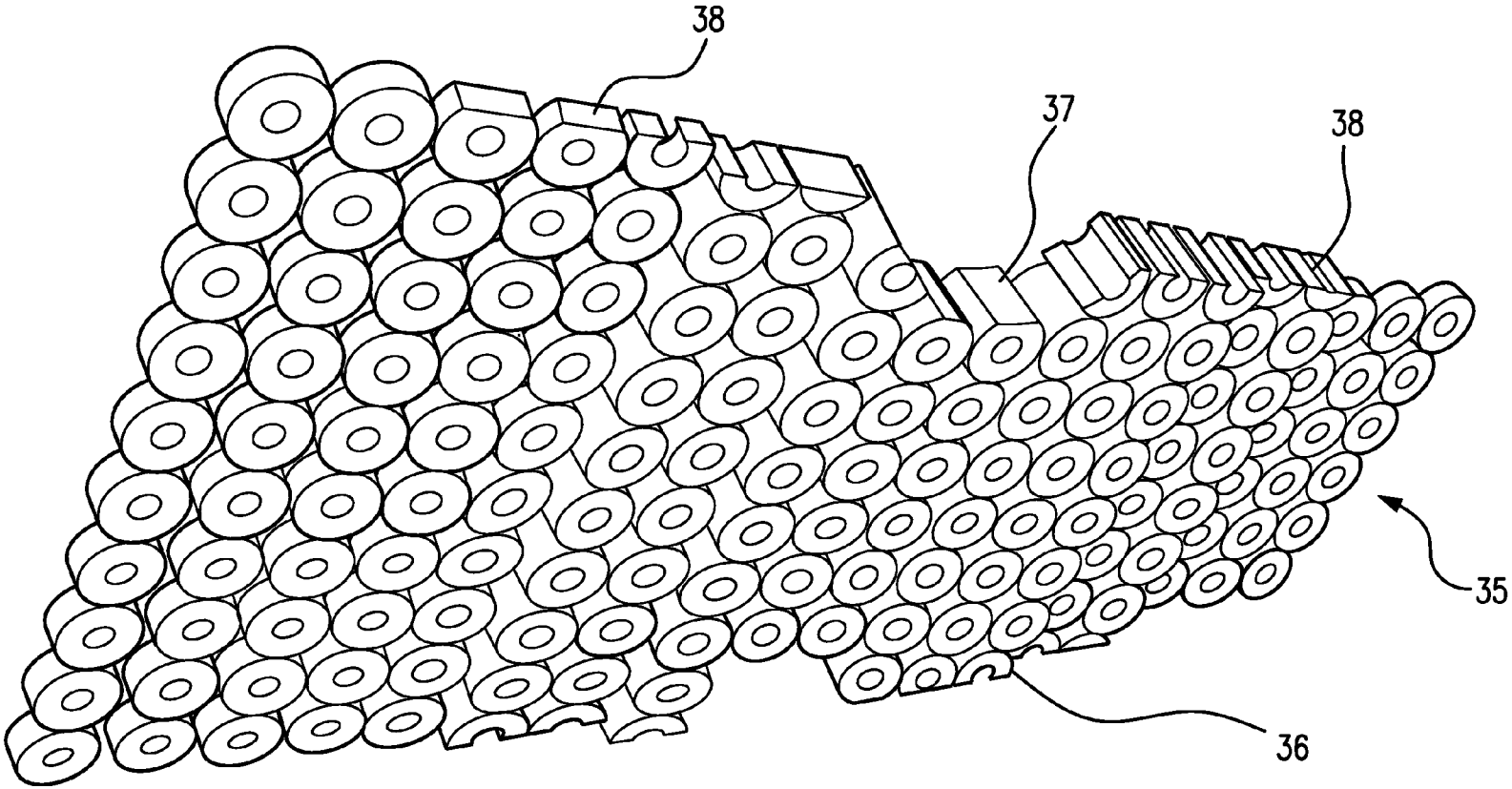
FIGS. 5A, 5B and 5C are a top perspective, detail and side view, respectively, of exemplary elbow padding according to one of the preferred embodiments of the present invention.
Figure 5B:
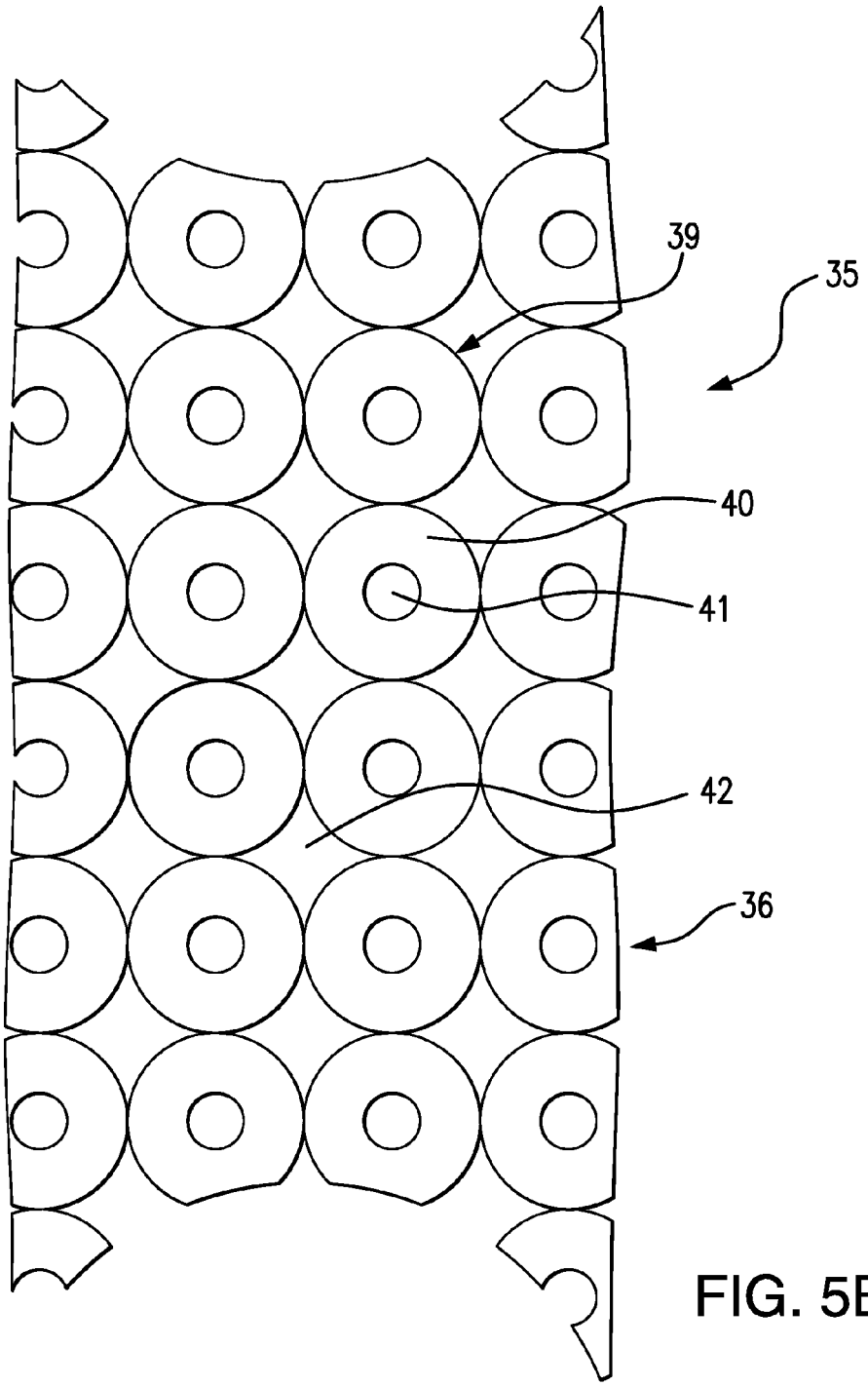
Figure 5C:
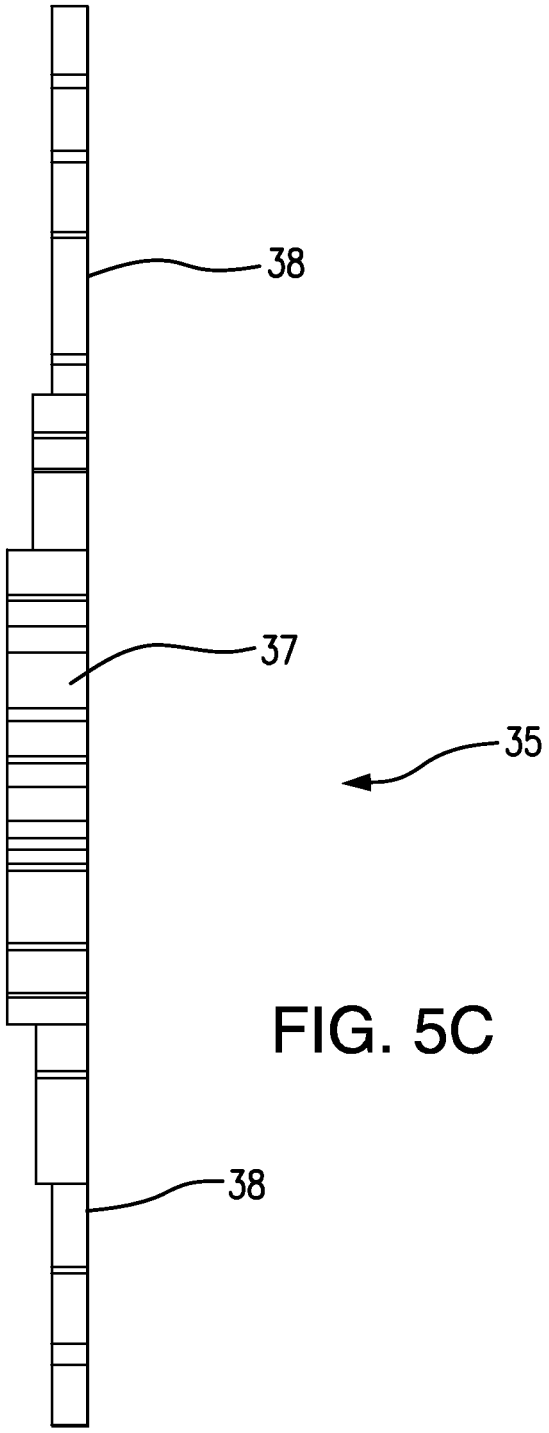

FIGS. 5A-5C illustrates exemplary padding for a hinge joint—again as applied to the elbow. This elbow padding 35 underlies the elbow shield 30 and absorbs any impact forces transmitted through that shield 30. The elbow padding 35 has a close lattice structure 36, comprising a network of cells 39, each having a cell wall 40 surrounding a central cell cavity 41, with cell interstices 42 between adjoining cell walls 40.

The close lattice structure 36 of the elbow padding, which contains less than 50% open space in the cell cavities 41 and interstices 42, permits the padding 35 to bend in a single plane to accommodate the bending motion of the elbow. The open space components of the padding (41 and 42) also reduce its weight and promote ventilation.

As shown in FIG. 5C, the elbow padding 35 has a central bulge 37, designed to be aligned with the elbow joint for better cushioning, with tapered flanks 38 on either side. Preferably, the elbow padding 35 is made of an elastomeric gel, such as silicone.

Figure 6A:
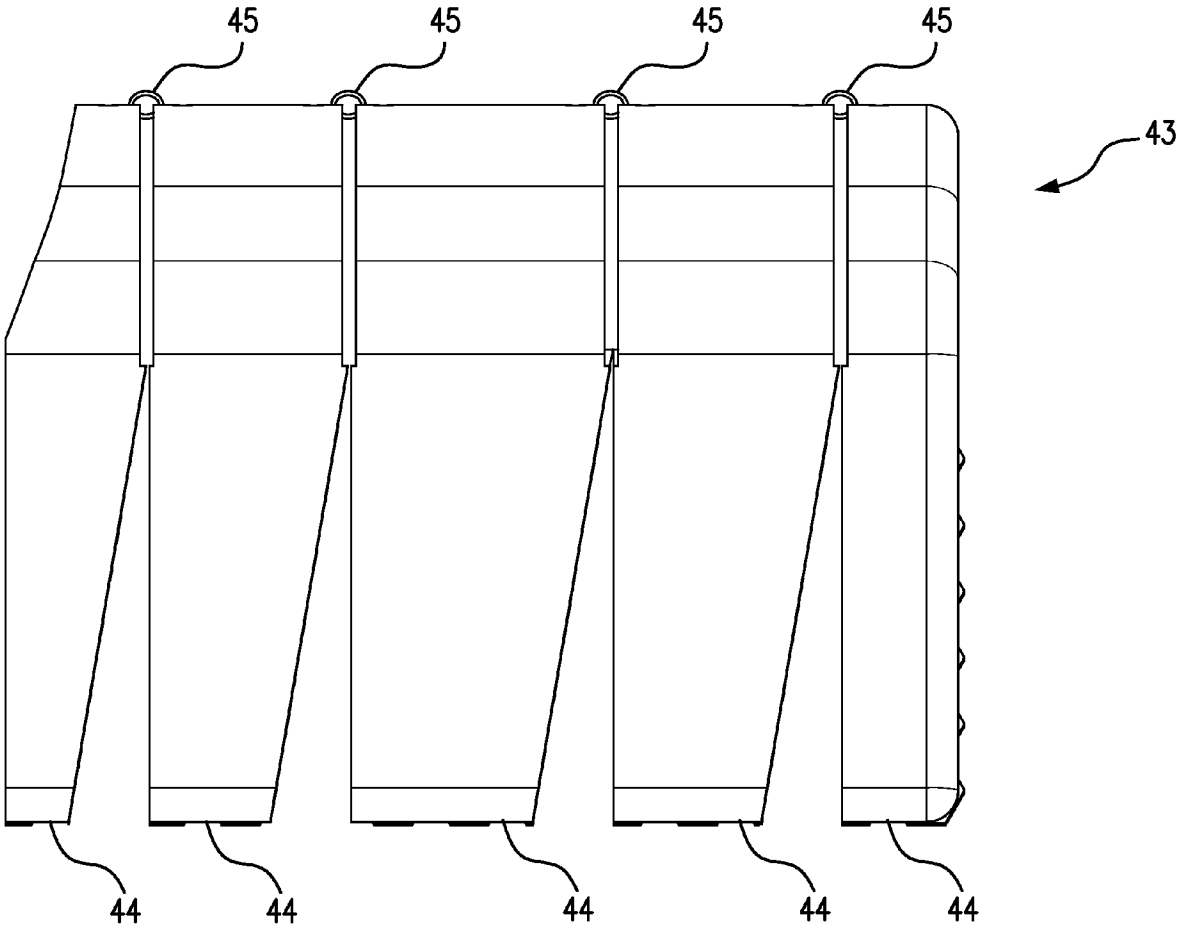
FIGS. 6A, 6B and 6C are a side, top and bottom perspective view, respectively, of an exemplary tied segmented shoulder shield according to one of the preferred embodiments of the present invention.
Figure 6B:
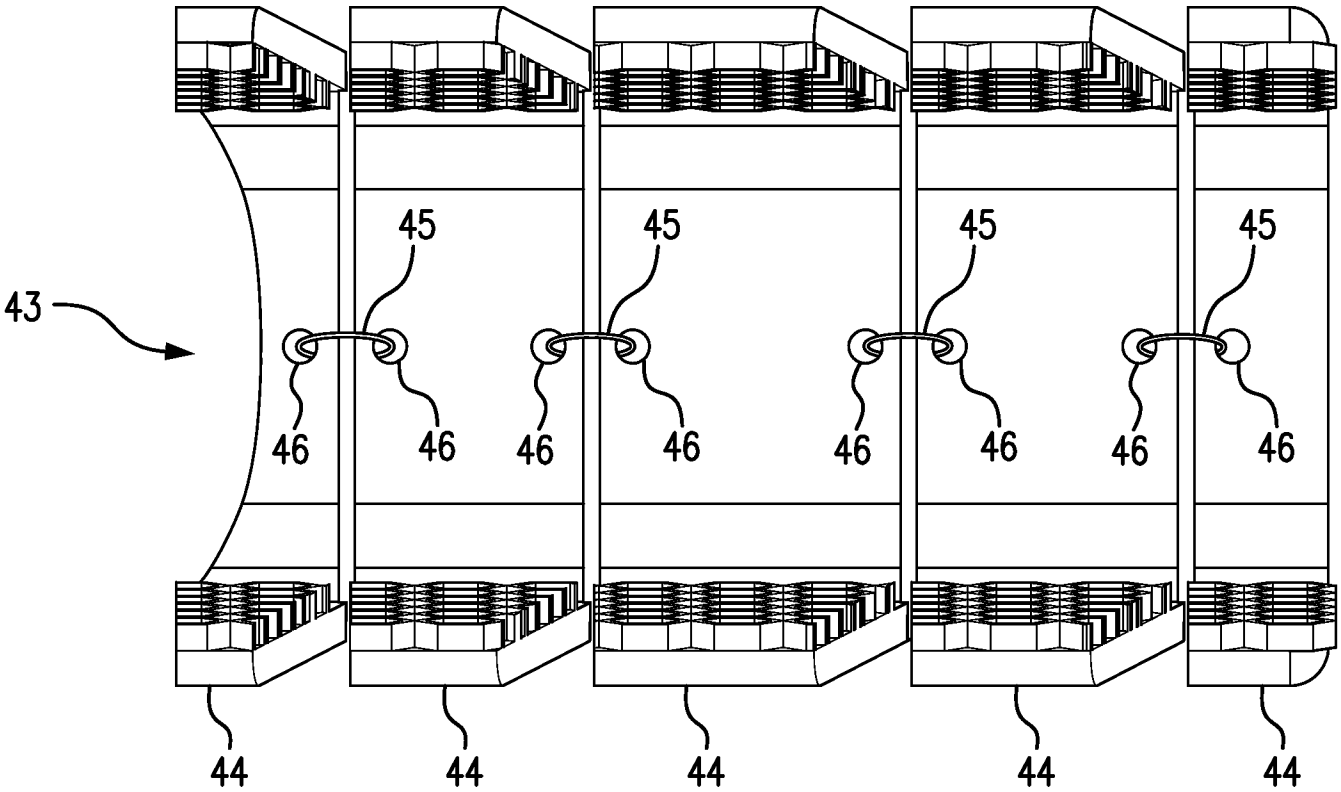
Figure 6C:
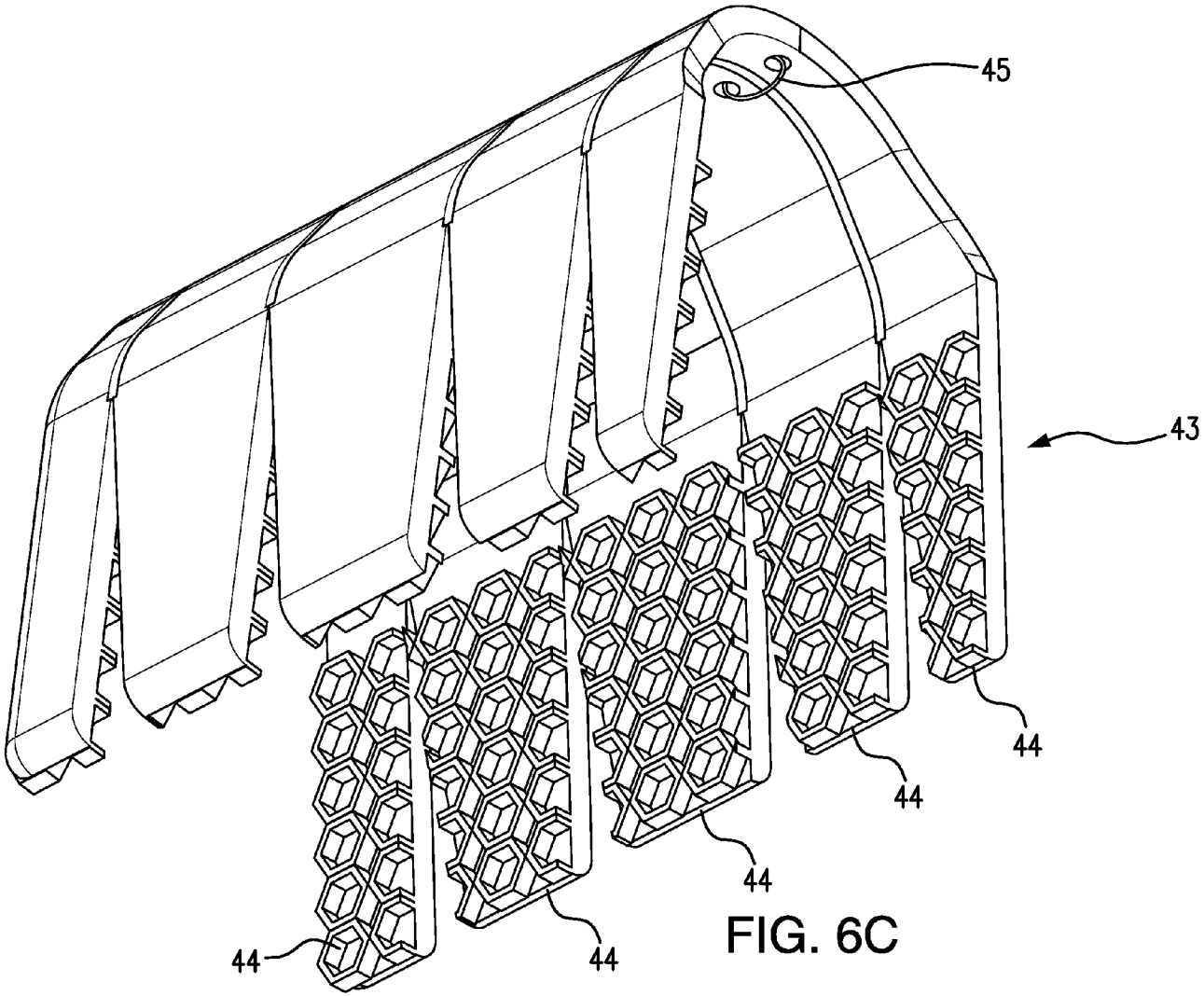

FIGS. 6A-6C illustrates an exemplary rigid shield for a ball-and-socket joint—in this case the shoulder joint and clavicle. The exemplary shoulder shield 43 comprises five discrete arcuate shield members 44 rotatably interconnected by four flexible connector ties 45. The connector ties 45 allow translational motion between the shield members 44 in all three planes (longitudinal, transverse and vertical, corresponding respectively to the x, y and z axes in the figures). This translational motion serves to redirect and deflect impact forces away from the shoulder and clavicle. The connector ties 45 also allow rotational motion between the shield members 44 about the longitudinal and transverse axes (x and y axes in the figures), thereby enabling an undulating motion among the shield members 44 that serves to dissipate and damp impact forces.

The connector ties 45 can consist of looped cable ties, such as those disclosed in U.S. Pat. Nos. 4,490,887 and 5,758,390, which are incorporated herein by reference. The connector ties can be connected through cooperating tie apertures 46 in top edges of the shield members 44, as best seen in FIG. 6B. Preferably, the shoulder shield 43 is made of a lightweight durable thermoplastic polymer, such as polycarbonate.

Figure 7A:
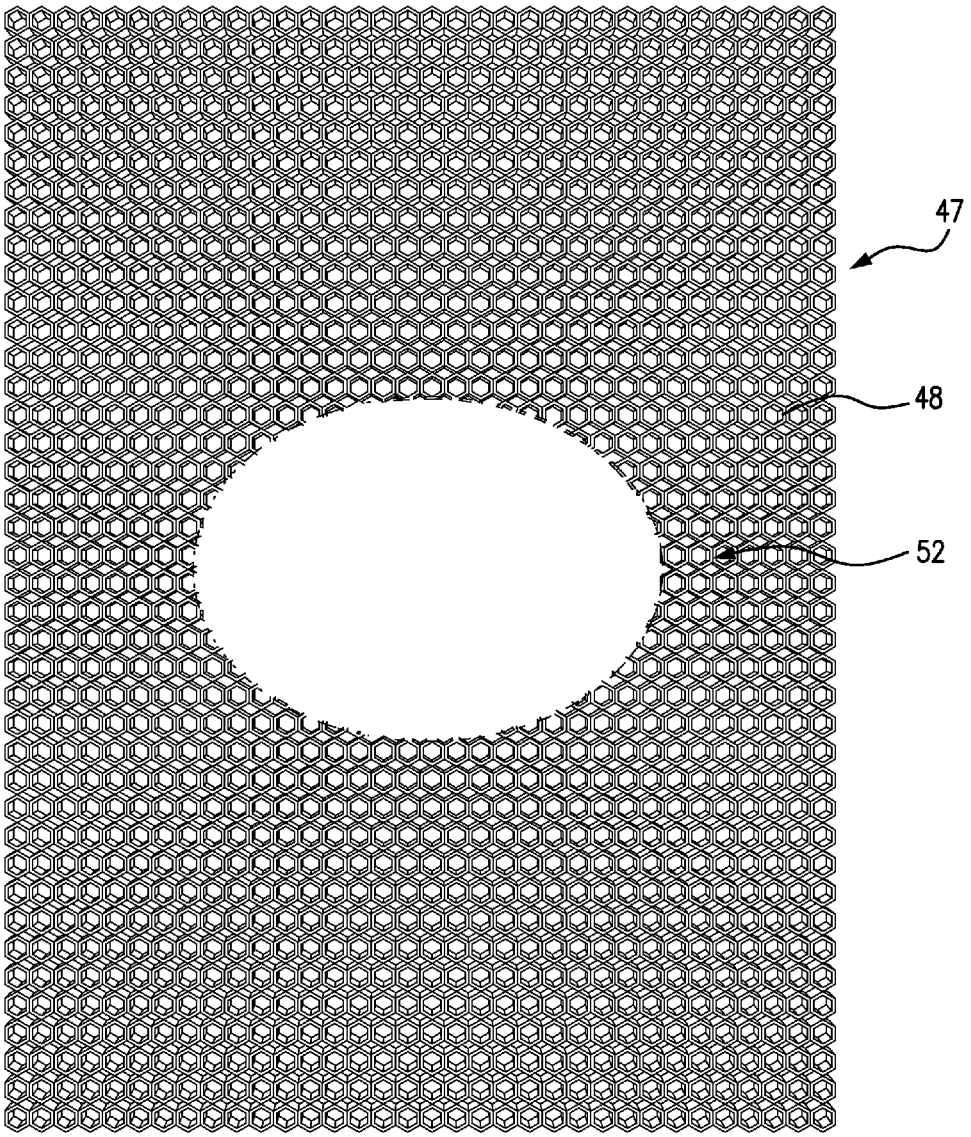
FIGS. 7A, 7B and 7C are a top, detail and side view, respectively, of exemplary shoulder padding according to one of the preferred embodiments of the present invention.
Figure 7B:
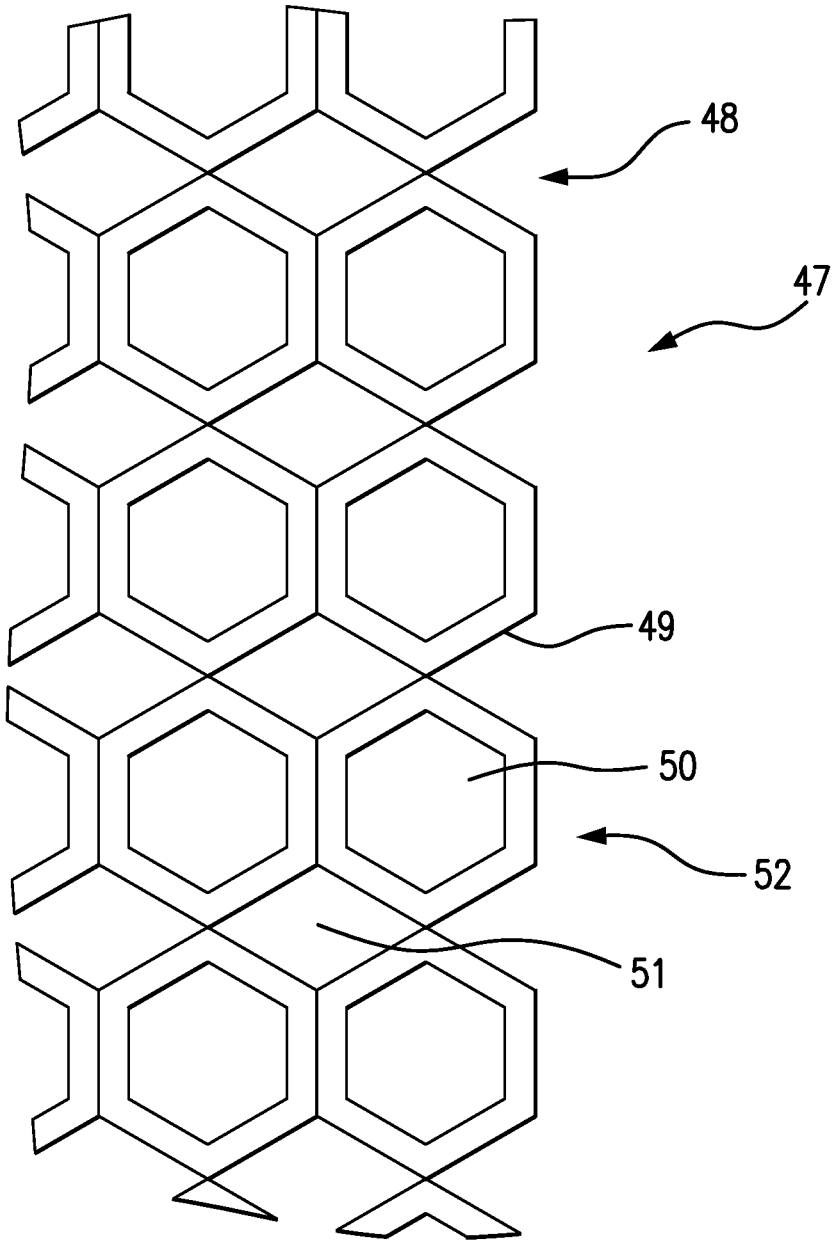
Figure 7C:
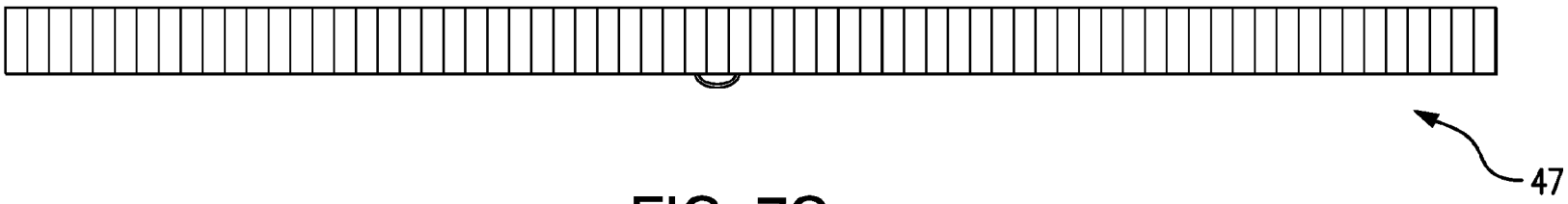

FIGS. 7A-7C illustrates exemplary padding for a ball-and-socket joint, as applied to the shoulder and clavicle. The shoulder padding 47 will underlie the shoulder shield 43 and absorb any impact forces transmitted through that shield 43. The shoulder padding 47 has an open lattice structure 48, comprising a network of cells 52, each having a cell wall 49 surrounding a central cell cavity 50, with cell interstices 51 between adjoining cell walls 49.

The open lattice structure 48 of the shoulder padding, which contains more than 50% open space in the cell cavities 50 and interstices 51, permits the padding 47 to bend in all three planes to accommodate the motion of the shoulder joint. The open space components of the padding (50 and 51) also reduce its weight and promote ventilation.

As shown in FIG. 7C, the shoulder padding 47 has a uniform thickness. This padding 47 is preferably made of an elastomeric gel, such as silicone.

Figure 8A:
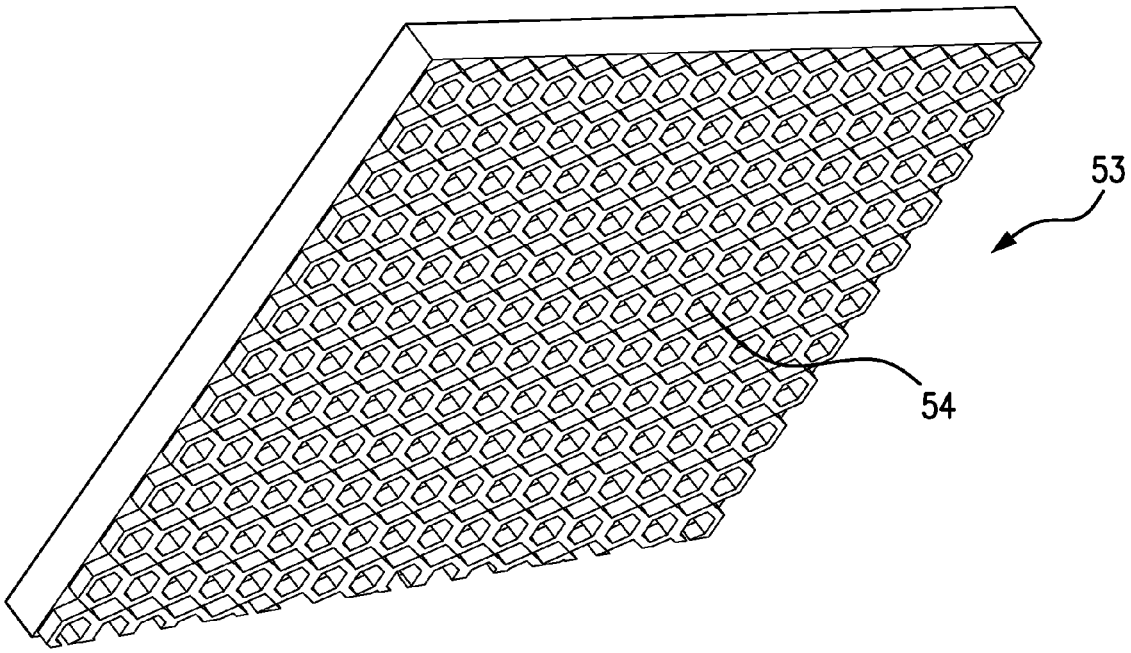
FIGS. 8A, 8B and 8C are a perspective, top and side view of an exemplary torso panel according to one of the preferred embodiments of the present invention.
Figure 8B:
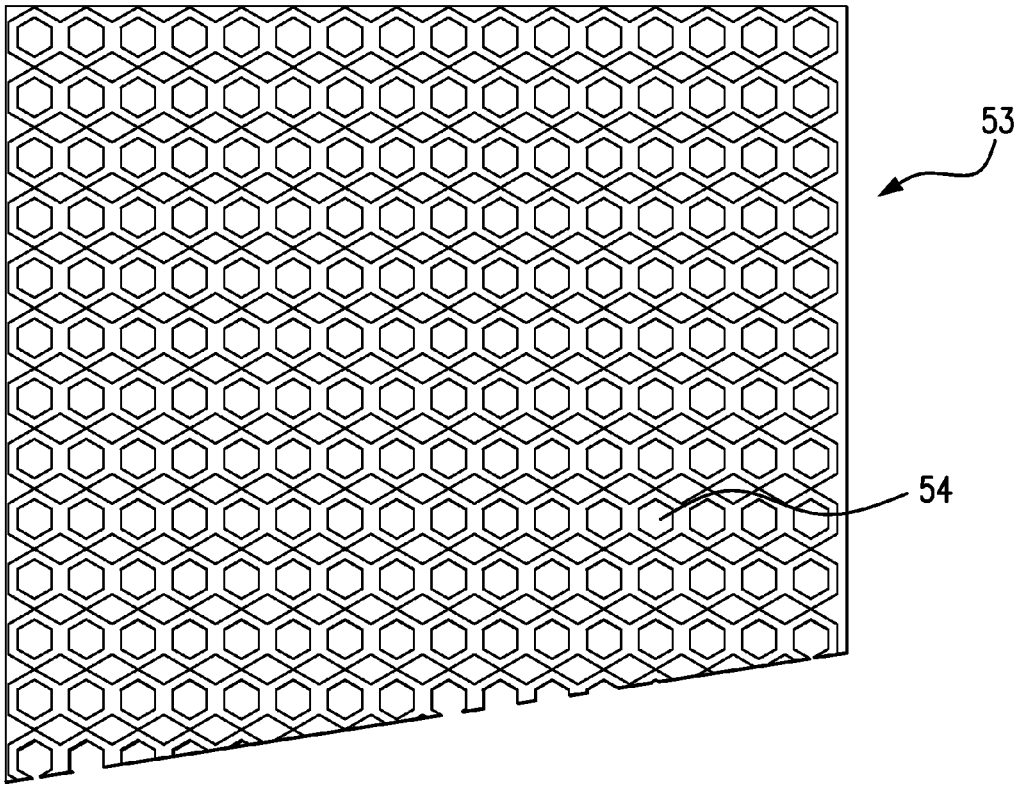
Figure 8C:
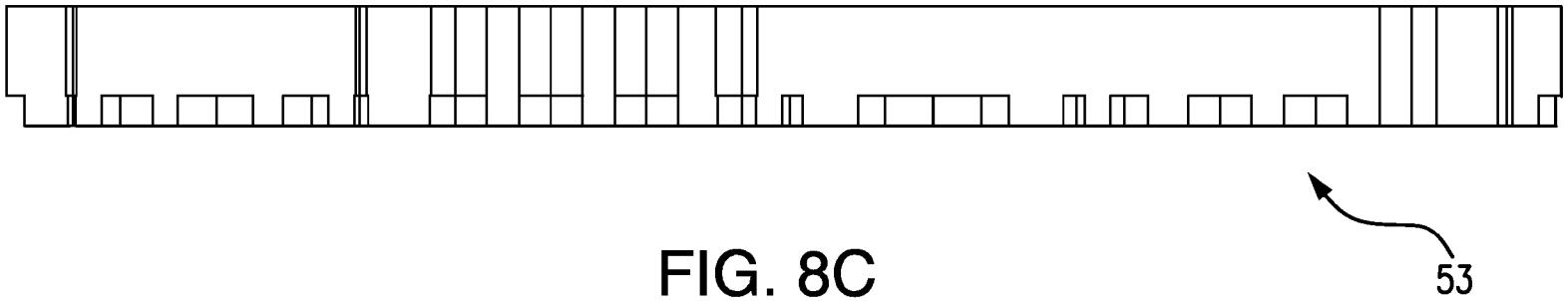

FIGS. 8A-8C illustrates an exemplary rigid panel for protection of a torso area, such as the chest or upper back. The exemplary torso panel 53 comprises a non-articulated, rigid quadrangular panel penetrated by a uniform grid of perforations 54, which reduce the weight and improve ventilation. As shown in FIG. 8C, the torso panel has a uniform thickness.

The preferred material for the torso panel 53 is a lightweight, durable thermoplastic polymer, such as polycarbonate.

Figure 9:
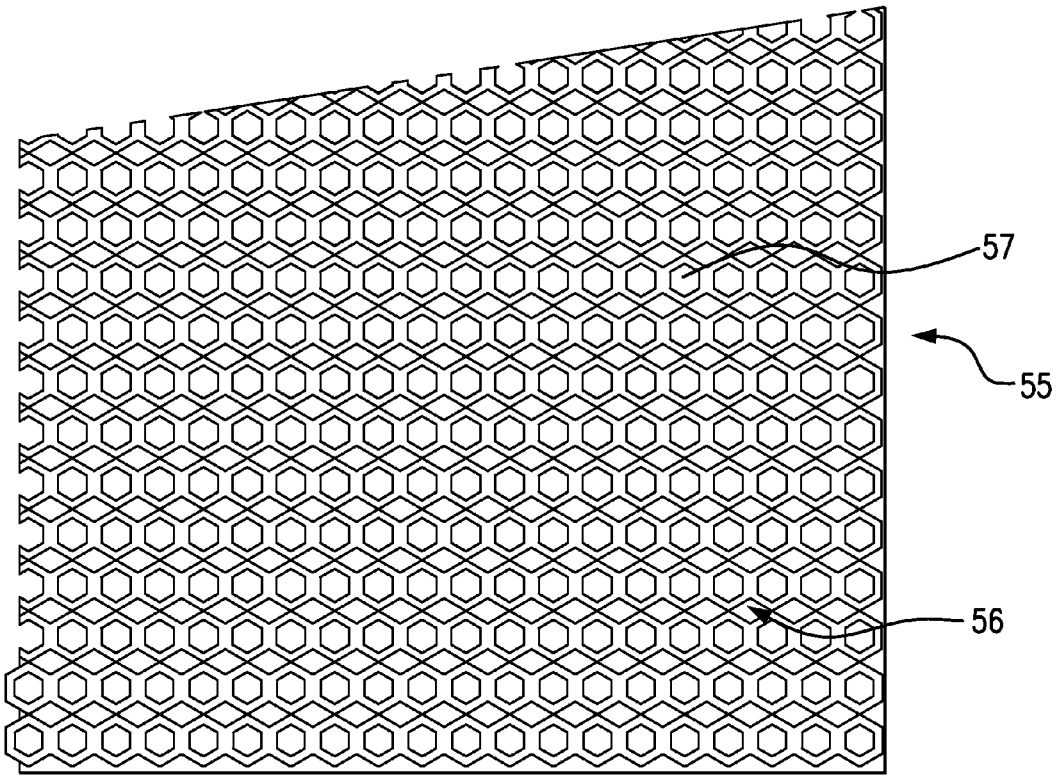
FIG. 9 is a top view of exemplary torso padding according to one of the preferred embodiments of the present invention.

FIG. 9 illustrates an exemplary torso padding 55, which underlies the torso panel 53 and absorbs any impact forces transmitted through the panel 53. The torso padding 55 has a very close lattice structure 56, comprising a uniform grid of cavities 57, such that there is less than 40% open cavity space in the padding. This structure enables flexing, but only minimal bending. The torso padding has a uniform thickness and is preferably made of an elastomeric gel, such as silicone.

Although the preferred embodiment of the present invention has been disclosed for illustrative purposes, those skilled in the art will appreciate that many additions, modifications and substitutions are possible, without departing from the scope and spirit of the present invention as defined by the accompanying claims.

What is claimed is:

1. An integrated method of protecting hinge joints, ball-and-socket joints and torso areas of a human body from impact forces, the method comprising the following steps:

(a) providing over one or more of the hinge joints a first padding, comprising a resilient elastomeric material having a close lattice structure, containing less than 50% open space, such that the first padding is bendable in a single plane, so as to accommodate bending of the hinge joint(s), and so as to dissipate impact forces directed toward the hinge joint(s);

(b) providing over the first padding a first shield comprising multiple rigid articulated arcuate shield segments hingeably interconnected by integral flexible connecting bands, such that the connecting bands act as hinges between the shield segments and enable the shield segments to bend in a single plane with respect to one another, so as to accommodate the bending of the hinge joint(s), and so as to deflect impact forces away from the hinge joint(s);

(c) providing over one or more of the ball-and-socket joints a second padding comprising a resilient elastomeric material having an open lattice structure, containing more than 50% open space, such that the second padding is bendable in three planes, so as to accommodate movements of the ball-and-socket joint(s), and so as to dissipate impact forces directed towards the ball-and-socket joint(s);

(d) providing over the second padding a second shield comprising multiple rigid discrete arcuate shield members rotatably interconnected by flexible connector ties, such that the connector ties allow both translational motion and rotational motion of the shield members in relation to one another, so as to accommodate the movements of the ball-and-socket joint(s), and so as to damp and dissipate impact forces directed toward the ball-and-socket joint(s), and so as to deflect impact forces away from the ball-and-socket joint(s);

(e) providing over one or more of the torso areas a third padding comprising a resilient elastomeric material having a very close lattice structure, containing less than 40% open space, such that the third padding is flexible, so as to accommodate movements of the torso area(s), and so as to dissipate impact forces directed toward the torso area(s); and (f) providing over the third padding a third shield comprising a single rigid shield panel shaped to conform to the torso area(s), so as to deflect impact forces away from the torso area(s).

2. The method of claim 1, wherein the first and third shields are penetrated by a uniform grid of perforations, so as to reduce the weight of the first and third shields and improve ventilation through the first and third shields.

3. The method of claim 1, wherein the connector ties comprise cable ties that are looped through cooperating apertures in the shield members.

4. The method of claim 2, wherein the first padding has a central bulge with tampered flanks, so as to better dissipate impact forces centrally directed toward the hinge joint(s).

* * * * *